US011547920B2

(12) United States Patent
Chin et al.

(10) Patent No.: US 11,547,920 B2
(45) Date of Patent: Jan. 10, 2023

(54) GOLF CLUBHEAD APPARATUS FOR SWING TRAINING AND METHODS FOR DEVICE ALIGNMENT TO IMPROVE BALL STRIKING CONSISTENCY

(71) Applicant: Ellipsis Golf LLC, New York, NY (US)

(72) Inventors: Ryan Chin, New York, NY (US); Kerry Chin, Coquitlam (CA); Devin Huang, Vancouver (CA)

( * ) Notice: Subject to any disclaimer, the term of this patent is extended or adjusted under 35 U.S.C. 154(b) by 0 days.

(21) Appl. No.: 17/131,114

(22) Filed: Dec. 22, 2020

(65) Prior Publication Data

US 2021/0197061 A1 Jul. 1, 2021

Related U.S. Application Data

(60) Provisional application No. 62/953,513, filed on Dec. 25, 2019.

(51) Int. Cl.
*A63B 69/36* (2006.01)
*A63B 71/06* (2006.01)

(52) U.S. Cl.
CPC ..... *A63B 69/3685* (2013.01); *A63B 71/0622* (2013.01); *A63B 2071/0633* (2013.01); *A63B 2071/0655* (2013.01); *A63B 2209/08* (2013.01); *A63B 2209/10* (2013.01); *A63B 2209/18* (2020.08)

(58) Field of Classification Search
CPC ..... A63B 69/3617
USPC ..... 473/236, 242, 251
See application file for complete search history.

(56) References Cited

U.S. PATENT DOCUMENTS 2,057,821 A 10/1936 Costello
3,437,341 A * 4/1969 Hasten, Jr. ..... A63B 69/3632 473/236
3,489,415 A * 1/1970 Smith ..... A63B 69/3685 473/236
3,912,277 A 10/1975 Pelz
4,002,343 A 1/1977 Eckert
(Continued)

FOREIGN PATENT DOCUMENTS

GB 2443268 A * 4/2008 ..... A63B 53/0416
GB 2457938 4/2008
(Continued)

*Primary Examiner* — Alvin A Hunter
(74) *Attorney, Agent, or Firm* — Bell Nunnally & Martin LLP

(57) ABSTRACT

A training device can easily be affixed or mounted to the hitting face of a golf club. The training device may provide auditory, tactile, and directional feedback for the user during practice so that he/she may learn how to strike the ball consistently on the sweet spot. A training device may include several raised surfaces of varying shapes rising from the base surrounding an aperture centered over the sweet spot of the golf club and larger than the surface area contacted by the ball. Use of the training device may reduce the user's variance from the "sweet spot" due to a strike not only along the longitudinal axis but also along the vertical axis. The user avoids impingement with the raised surfaces of the training device by striking the ball within a pre-set tolerance as well as within the boundaries of the aperture.

19 Claims, 4 Drawing Sheets

(56) References Cited

U.S. PATENT DOCUMENTS 4,139,198 A * 2/1979 Kanavas ..... A63B 69/38 473/236
4,323,246 A * 4/1982 Nehrbas, Jr. ..... A63B 69/3685 473/236
5,011,153 A 4/1991 Watkins
5,135,228 A * 8/1992 Hawkins, Sr ..... A63B 63/00 473/236
5,478,078 A * 12/1995 Lee ..... A63B 69/3685 473/236
5,595,543 A 1/1997 Wolk
D385,324 S * 10/1997 Ubaney ..... D21/759
5,958,536 A 9/1999 Gelsinger et al.
5,961,392 A * 10/1999 Hillock ..... A63B 69/3617 473/236
6,450,903 B1 9/2002 Tate
6,729,966 B1 * 5/2004 Barelli ..... A63B 69/3685 473/226
6,739,980 B2 * 5/2004 Scott ..... A63B 53/007 473/200
6,780,119 B1 * 8/2004 Gankas ..... A63B 69/3685 473/236
6,821,212 B2 * 11/2004 Fowler ..... A63B 69/3632 473/236
7,134,967 B2 11/2006 Lester
7,416,492 B2 8/2008 Wesley
D583,888 S * 12/2008 Nehrbas ..... D21/759
7,648,424 B2 * 1/2010 Hinojosa ..... A63B 53/0487 473/236
7,819,762 B2 10/2010 Bernal-Silva et al.
D659,213 S * 5/2012 Schultz ..... D21/759
8,303,433 B2 11/2012 Roach et al.
8,382,603 B1 2/2013 Hong
8,435,130 B2 5/2013 Cheresko
8,469,833 B1 * 6/2013 Schultz ..... A63B 53/0487 473/236
8,827,825 B2 9/2014 Kaufman
10,052,543 B1 8/2018 Steele et al.
10,406,421 B2 9/2019 Faucette
2009/0325722 A1 12/2009 Mier et al.
2012/0052974 A1 * 3/2012 Fellows ..... A63B 69/3617 473/242
2017/0029625 A1 2/2017 Stolarz et al.

FOREIGN PATENT DOCUMENTS

GB 2457938 A * 9/2009 ..... A63B 69/3685
JP 08126729 A * 5/1996
JP 2010252889 A * 11/2010
JP 2012016369 A * 1/2012

* cited by examiner

GOLF CLUBHEAD APPARATUS FOR SWING TRAINING AND METHODS FOR DEVICE ALIGNMENT TO IMPROVE BALL STRIKING CONSISTENCY

CROSS REFERENCE TO RELATED APPLICATION

This application claims the benefit under 35 U.S.C. § 119(e) of U.S. Provisional Patent Application Ser. No. 62/953,513 filed on Dec. 25, 2019, which is incorporated by reference in its entirety.

FIELD OF THE DISCLOSURE

The present disclosure generally relates to a training device that provides multidimensional tactile, positional, visual and auditory feedback for the purpose of helping an individual improve his/her golf swing technique, specifically ball striking during putting strokes.

BACKGROUND

Generally speaking, the game of golf places a priority on accuracy, precision, and consistency. As players progress from beginners to advanced amateurs and possibly into the competitive world of professional golf, very little separates really competent players from each other. The uppermost echelons of competitive golf consist of an entire field of players who could, on any given day, produce a low score and emerge victorious. Golf, however, is not a lottery, and perhaps no other sport attracts all manner of devices/tools to help train participants of all levels. Central to this training or practice is ball striking consistency. Recent statistics show that the average golfer uses the putter more than 40% of the time over the course of a round of golf. Therefore, there is no practice more valuable to quantifiable better game of golf that improving one's putting consistency, and therefore, success.

In putting, even if the surface of the green to be traversed after hitting the ball is dead flat, the golfer optimally maximizes the chances of the ball going in the hole when it is traveling at the correct velocity and in the correct direction. A ball hit off-center will be subject to the twisting of the club and will impart not only unwanted sidespin on the golf ball but may also be directed at an angle from the intended path. A ball struck off-center will also result in a less-than-optimal energy to the ball resulting in the ball going a shorter distance than was intended. There are many factors that the golfer must take into account, including the type, texture, and grain of the grass on the green, the speed of the green, the slope of the green, and the wind. A putt of any distance on a green not perfectly flat will need to have both correct distance and direction which results from a combination of correct direction given the force applied to the ball which can vary given the force applied. This is best achieved with a point of contact as close as possible to the "sweet spot," with the clubface traveling perfectly parallel to the plane of the intended target line and with the striking face making contact perfectly perpendicular to this plane of the intended target line. This serves to reduce unwanted twisting of the club, to minimize unwanted spin, and to minimize the loss of optimal forward momentum.

All putter heads have a center point referred to as the sweet spot. The "sweet spot" is the precise point on the striking surface with the ball where maximum energy transfer occurs with the least amount of twisting of the implement, or as the point closest to the intended strike location. It is usually demarcated by the intersection of alignment lines on the top of the putter or on the center of the face, or by a demarcation on the face by the manufacturer. It is common for golfers to have an accumulation of strikes that resemble an oval pattern of varying sizes surrounding the sweet spot. Generally speaking, the variance of this collection of strikes is a direct determinant of the skill of the putter in repeating the stroke as optimally intended. The accumulation of strikes generally will show more variation in misses on the heel and toe (the axis parallel to the ground) than in misses high or low (the axis perpendicular to the ground) due to the hand position being away from the body during the stroke. Current solutions on the market suffer many drawbacks that hinder the ability of the golfer to benefit from training with competitive products. Therefore, a need exists for a device capable of multidimensional feedback so that all major variables affecting the success of the putting stroke are contained within a single, economical, easy to install, and possibly biodegradable device.

SUMMARY

Embodiments of the present disclosure may provide a golf training device affixed to a hitting face of a golf club, the golf training device comprising: a central aperture that may identify a hitting zone centered concentrically relative to a sweet spot of the golf club; a curved surface provided around the central aperture; a base surface provided around the curved surface, wherein the curved surface may protrude in a variable manner outward from the base surface to deflect a ball when struck on the curved surface; and a contoured bump centered along an x-axis below the sweet spot to deflect the ball in any of three dimensions when struck. The central aperture may be round, oval, or oblong. The golf training device also may include a backing surface to which an adhesive material may be applied to affix the golf training device to the golf club. The golf training device may be removable from or permanently affixed to the golf club. The contoured bump may not impact the ball when the ball is struck in the z-axis. The contoured bump may affect direction, feel, and/or sound of the ball when struck outside a tolerance distance and below the sweet spot along a z-axis.

Other embodiments of the present disclosure may provide a golf training device affixed to a hitting face of a golf club, the golf training device comprising: an aperture positioned over a sweet spot of the golf club and larger than a surface contacted by a ball when hit by the golf club; a base surrounding the aperture; and a plurality of raised surfaces of varying shapes rising from the base, wherein when the ball impacts the surface contacted by the ball outside the aperture, the impact may impinge on one or more of the plurality of raised surfaces, providing auditory, tactile, and/or directional feedback for a user of the golf club. The golf training device may be removably affixed to or permanently affixed to a hitting face of the golf club. It may be affixed through a magnetic mount or through an adhesive material. The aperture may be round, oval, or oblong. The user's variance from the sweet spot may be reduced along a longitudinal axis and along a vertical axis. The golf training device may be formed of a biodegradable material. The golf training device also may include a bottom protrusion that may denote visual bracketing of the ball along a z-axis and ensure correct placement and alignment of the golf training device at a center of a length of the club along the z-axis.

Further embodiments of the present disclosure may provide a golf training device affixed to a face of a golf club, the golf training device comprising: a central aperture that may identify a hitting zone centered concentrically relative to a sweet spot of the golf club; a curved surface provided around the central aperture that may provide visual bracketing to the ball and deflect the ball when the club does not strike the ball at the central aperture; and a bottom protrusion that may denote visual bracketing of the ball along a z-axis and ensure correct placement and alignment of the golf training device at a center of a length of the club along the z-axis. The golf training device may be affixed to a front striking surface of the face of the golf club. The golf training device also may include a backing surface that may affix the golf training device to the club. The bottom protrusion may deflect the ball when the face of the club is not at a correct distance from the ground at impact.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a training device that a user can easily affix or mount to the hitting face of a golf club. The training device may provide auditory, tactile, and directional feedback for the user during practice so that he/she may learn how to strike the ball consistently on the sweet spot. A training device according to embodiments of the present disclosure may include several raised surfaces of varying shapes rising from the base surrounding an aperture or opening that is circular or oval centered over the sweet spot of the golf club, and slightly larger than the surface area contacted by the ball. When a ball impacts the striking surface correctly, the impact does not impinge on any of the raised surfaces, resulting in a desirable direction, distance, and trajectory of the contacted ball. Desirable contact also may provide the same sensory experiences as may be experienced without use of the training device in a visual, audible and somatosensory way as the contact happens fully within the aperture. When a ball impacts the striking surface incorrectly, the impact does not completely happen within the aperture region and does impinge on any, some or all of the raised surfaces, resulting in an angular deflection away from the intended target resulting in an undesirable direction, distance, and trajectory as compared to a ball struck correctly and fully within the aperture.

Embodiments of the present disclosure may reduce the user's variance from the "sweet spot" due to a strike in two dimensions, not only along the longitudinal axis but also along the vertical axis. The user must avoid impingement with the raised surfaces of the training device according to embodiments of the present disclosure by striking the ball within a pre-set tolerance as well as within the boundaries of the aperture where there is no material. This tolerance can be variable amongst different versions of the training device according to embodiments of the present disclosure.

A training device according to embodiments of the present disclosure may be attached by any suitable means, including, but not limited to, magnetic mount or by pressing on via double-faced pressure sensitive adhesive material or other similar adhesive mechanism between the face of the striking surface and the rear side of the backing member of the training device. A training device according to embodiments of the present disclosure may be made of any suitable material, including biodegradable materials, and by any method. In embodiments of the present disclosure, the training device may be made by methods including, but not limited to, injection molding, vacuum castings, three-dimensional printing, or any other suitable method of fabrication. The chosen material, in all cases, may provide an impact sensation relating to feel and sound that is noticeably differentiated from that of ball contact on the intended striking surface of the golf putter face.

Figure 1:
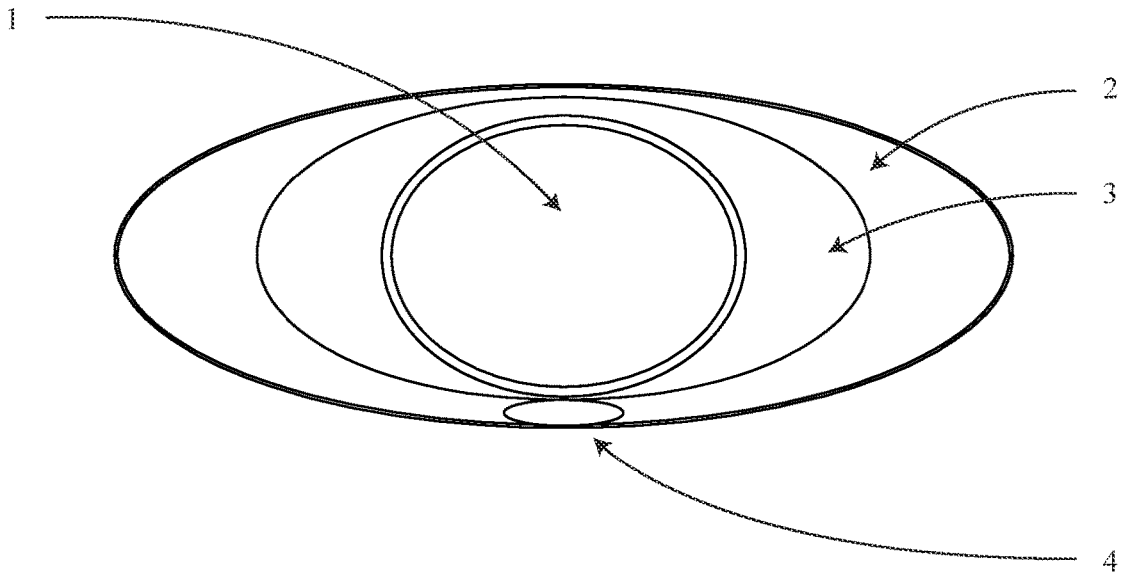
FIG. 1 illustrates a front view of a training device according to an embodiment of the present disclosure.

FIG. 1 depicts a front view of a training device according to an embodiment of the present disclosure showing its general shape and features that contribute to its unique multidimensional stroke feedback. Central aperture 1 may be round, oval, oblong, or other similar shape to reflect a certain ideal hitting zone centered concentrically relative to the sweet spot. The shape may reflect the general dispersion of misses being an ovoid scatter pattern wider than high along the x-axis. In this way, the allowable tolerance for a successful strike (that results in no contact with the training device) can be equal in a radial fashion or 360 degrees around. A successful strike by the player may result in ball contact with the original clubface surface with no modification to the sound, feel, or direction of ball travel.

The training device according to embodiments of the present disclosure may have some tangible thickness provided by base surface 2 that may contribute to the durability of the device as well as providing a surface with backing to which an adhesive material of any level of adhesion can be applied. The device according to embodiments of the present disclosure may have a variable thickness throughout in order to minimize the weight thereof. The device may include curved surface 3 that may protrude in a variable manner outwards from the base surface, shaped in a manner so as to significantly deflect the path of the ball if the ball is struck on the area of curved surface 3 at increasingly acute angles to the intended target depending on the severity of the miss relative to the sweet spot.

An adhesive backing surface may allow the device to securely mount to the face of a golf club, either to be removed at a later time by the user, or to be left installed on the golf club on a more permanent basis. The device may include contoured bump 4 centered along the x-axis directly below the sweet spot of the clubface and that may serve to deflect the ball in any of three dimensions in a noticeable manner when struck. Contoured bump 4 may not impact the ball at all should the user swing the club and strike the ball in the appropriate z-axis; however, it may significantly affect the direction, feel, and/or sound should the area of strike be outside the tolerance distance (depending on the sport) and below the sweet spot along this z-axis due to the incorrect distance above the ground of the putter. For example, if the putter is too far from the ground at contact, then contact may be made toward the bottom of the club face and away from the center of gravity. This can cause the ball to get airborne, to bounce as the ball is driven into the ground, or to suffer energy loss and the putt may come up short of its intended target. The ball may get airborne or bounce, as a strike too low on the club may actually contact the bottom edge of the front face of the putter, meaning the ball may be deflected in different directions along the z-axis. Another symptom of this distance from the ground may also from the player adding or subtracting loft to the putter at impact which could cause the ball to get airborne, or to bounce. Any putt struck away from the perfect center of gravity of the golf club results in a loss of energy from optimal, which results in the ball not traveling the intended distance, or in the intended direction.

Figure 2:
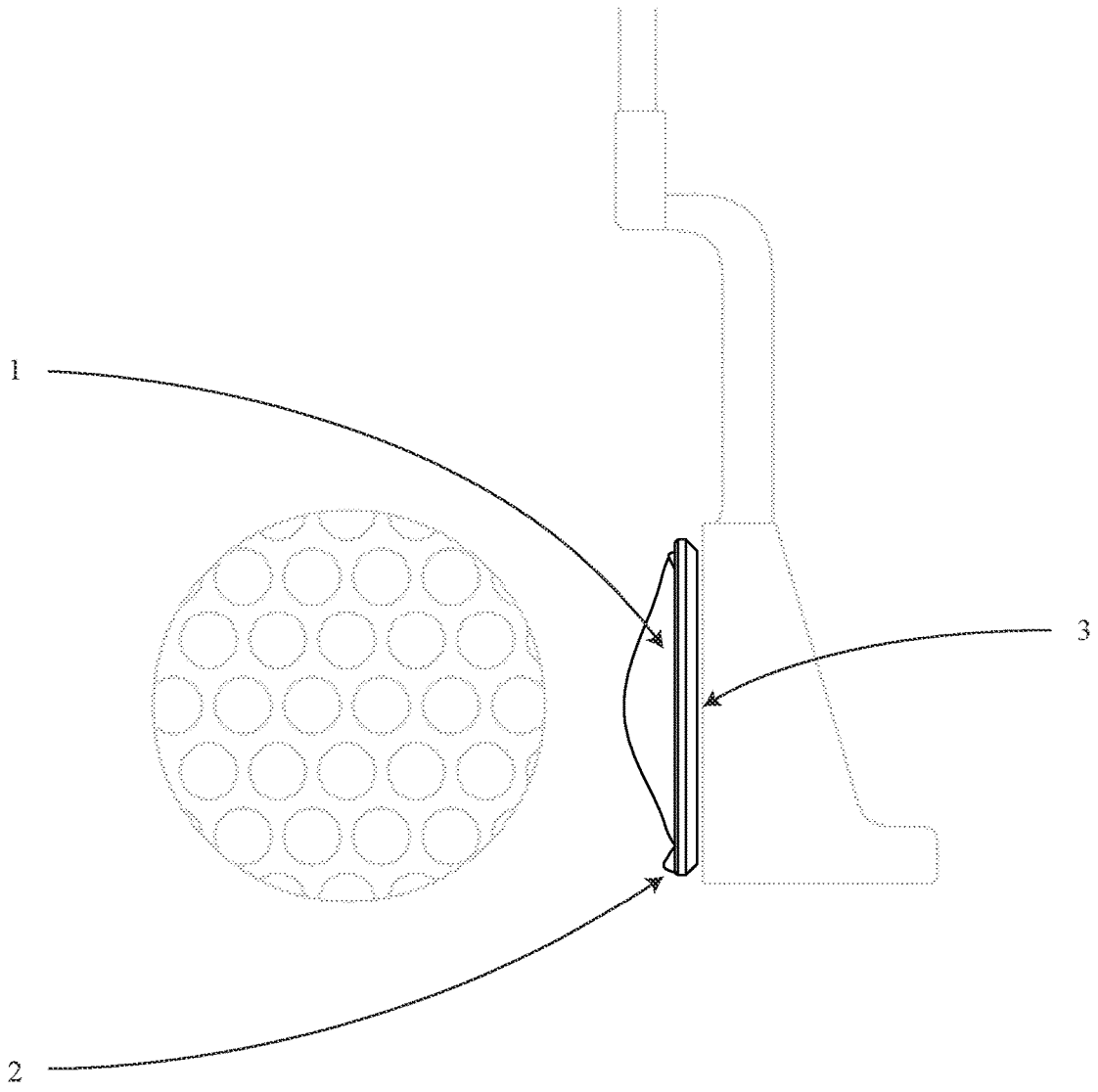
FIG. 2 depicts a side view of a training device according to an embodiment of the present disclosure.

FIG. 2 depicts a side view of a training device according to an embodiment of the present disclosure showing its general shape, proposed mounting orientation centered over the longitudinal center of the putter face, and features that contribute to its novel training characteristics. The training device may be mounted on the front striking surface of the clubface. Curved front surface 1 may include significant relief to provide the ability to deflect the ball if the club does not strike the ball at the center. Bottom protrusion 2 may have a certain profile so as to deflect the ball only if the clubface is not the correct distance from the ground at impact. Backing surface 3 may provide physical coupling of the training device to the clubhead in a manner that is secure, yet easily removed, if desired.

Figure 3:
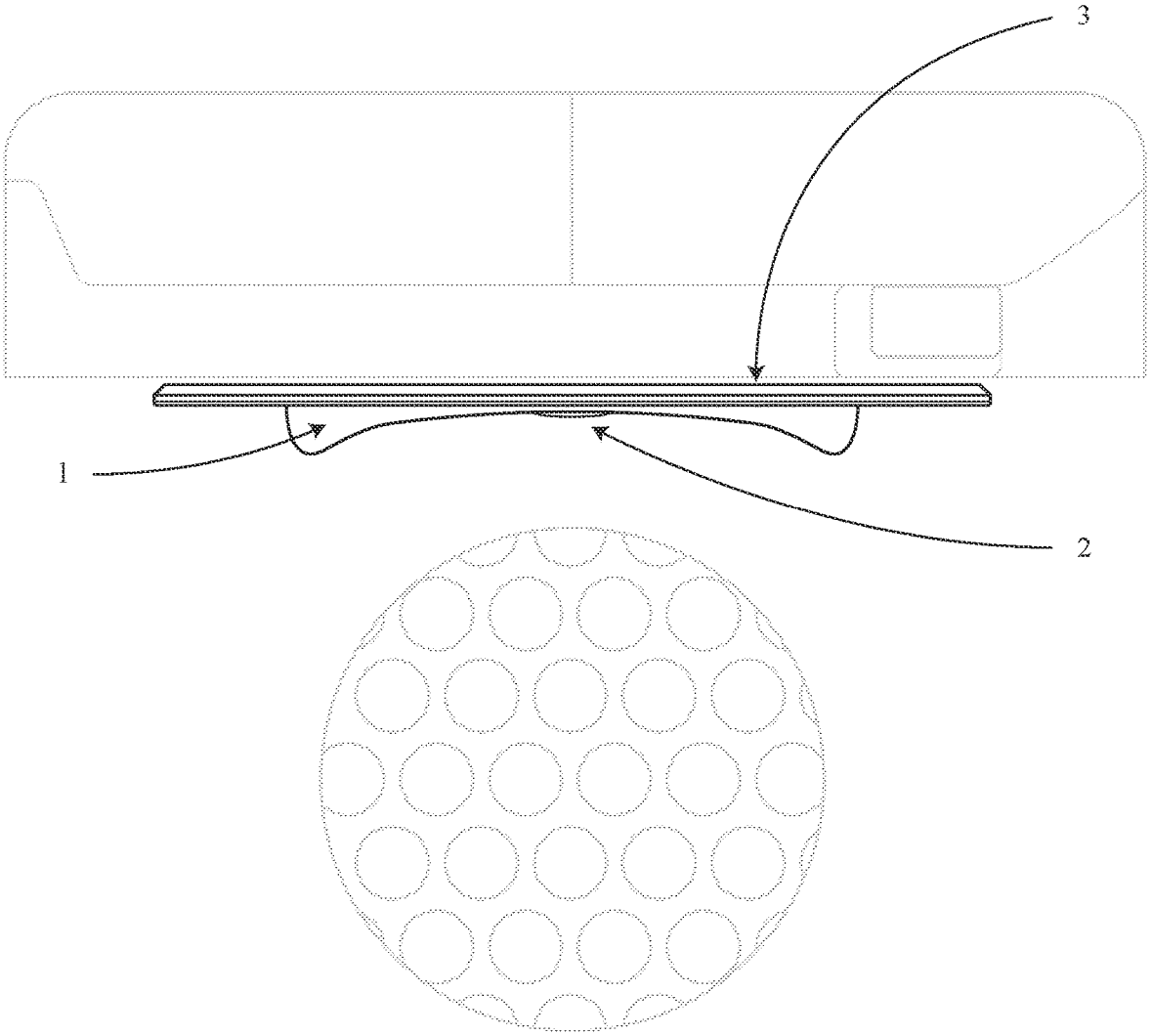
FIG. 3 depicts a top view of a training device according to an embodiment of the present disclosure.

FIG. 3 depicts a top view of a training device according to an embodiment of the present disclosure showing its general shape and features that contribute to its novel training characteristics. In the view depicted in FIG. 3, the training device may be installed for practice, and the top plan view depicts looking down at a putter at address. Curved front surface 1 may include significant relief from the hitting surface of the putter. This relief, which may be on both sides toward the toe and heel of the putter, may give a visual bracketing or "framing" to the golf ball, allowing the golfer to visualize the intended targeted area of a successful strike at all times between the side protrusions along the x-axis. Bottom protrusion 2 may also be seen from top view, denoting both a visual bracketing of the golf ball along the z-axis and also ensuring the correct placement and alignment of the training device according to embodiments of the present disclosure at the exact center of the length of the clubhead along the x-axis. Backing surface 3 may be flat to the striking surface of the putter in embodiments of the present disclosure.

Figure 4:
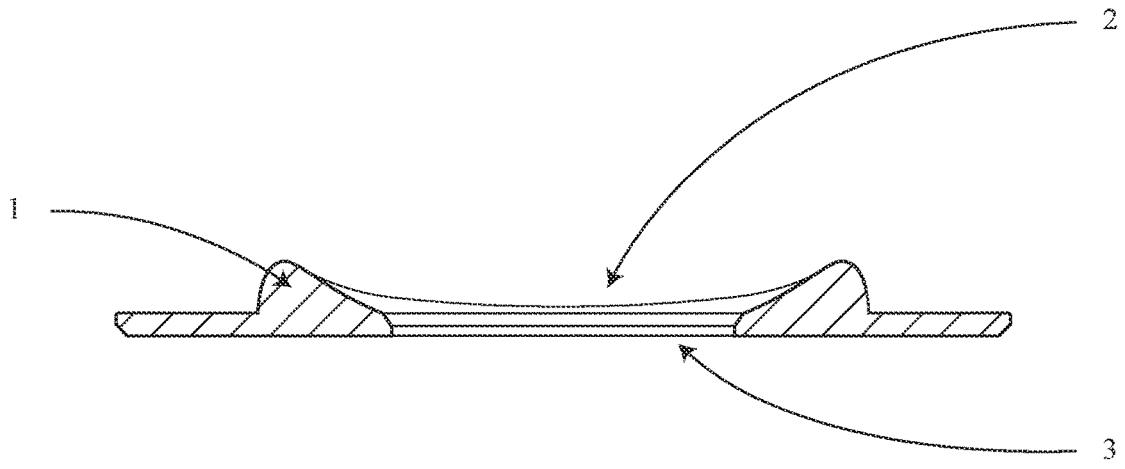
FIG. 4 depicts a longitudinal cross-sectional view of a training device according to an embodiment of the present disclosure.

FIG. 4 depicts a longitudinal cross-sectional view of the training device according to an embodiment of the present disclosure. This view depicts the graduated curvature relief of front surface 1 which may serve to deflect the ball at an increasingly acute angle by an increasingly imperfect stroke relative to the intended direction of a perfect strike. The bottom relief area which, when installed, may be closest to the bottom of putter face 2 does not include the ovoid protrusion shown in FIGS. 1 and 4. A larger aperture with a larger tolerance for successful strike may be incorporated in this embodiment of the present disclosure. Similar to that depicted in FIG. 3, backing surface 3 may be flat to the striking surface of the putter and may be where the attachment method or possible adhesive compound is applied.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A golf training device affixed to a hitting face of a golf club, the golf training device comprising:

a central aperture that identifies a hitting zone centered concentrically relative to a sweet spot of the golf club;

a curved surface provided around the central aperture, the curved surface having a graduated curvature relief;

a base surface provided around the curved surface, wherein the curved surface protrudes in a variable manner outward from the base surface to deflect a ball at increasingly acute angles depending on a distance from the sweet spot where the ball struck the curved surface;

a contoured bump centered along an x-axis below the sweet spot to deflect the ball in any of three dimensions when struck; and wherein the golf training device is formed of a biodegradable material.

2. The golf training device of claim 1, wherein the central aperture is round, oval, or oblong.

3. The golf training device of claim 1 further comprising:

a backing surface to which an adhesive material is applied to affix the golf training device to the golf club.

4. The golf training device of claim 3, wherein the golf training device is removable from the golf club.

5. The golf training device of claim 3, wherein the golf training device is permanently affixed to the golf club.

6. The golf training device of claim 1, wherein the contoured bump does not impact the ball when the ball is struck in the z-axis.

7. The golf training device of claim 1, wherein the contoured bump affects direction, feel, and/or sound of the ball when struck outside a tolerance distance and below the sweet spot along a z-axis.

8. A golf training device affixed to a hitting face of a golf club, the golf training device comprising:

an aperture positioned over a sweet spot of the golf club and larger than a surface contacted by a ball when hit by the golf club;

a base surrounding the aperture;

a plurality of raised surfaces of varying shapes rising from the base, wherein when the ball impacts the surface contacted by the ball outside the aperture, the impact impinges on one or more of the plurality of raised surfaces, providing auditory, tactile, and/or directional feedback for a user of the golf club; and wherein the golf training device is formed of a biodegradable material.

9. The golf training device of claim 8, wherein the golf training device is removably affixed to a hitting face of the golf club.

10. The golf training device of claim 8, wherein the golf training device is permanently affixed to a hitting face of the golf club.

11. The golf training device of claim 8, wherein the golf training device is affixed to the golf club through a magnetic mount.

12. The golf training device of claim 8, wherein the golf training device is affixed to the golf club through an adhesive material.

13. The golf training device of claim 8, wherein the aperture is round, oval, or oblong.

14. The golf training device of claim 8, wherein a user's variance from the sweet spot is reduced along a longitudinal axis and along a vertical axis.

15. The golf training device of claim 8 further comprising:

a bottom protrusion that denotes visual bracketing of the ball along a z-axis, deflects the ball, and ensures correct placement and alignment of the golf training device at a center of a length of the club along the z-axis.

16. A golf training device affixed to a face of a golf club, the golf training device comprising:

a central aperture that identifies a hitting zone centered concentrically relative to a sweet spot of the golf club;

a curved surface provided around the central aperture that provides visual bracketing to the ball and deflects the ball when the club does not strike the ball at the central aperture;

a bottom protrusion that denotes visual bracketing of the ball along a z-axis and ensures correct placement and alignment of the golf training device at a center of a length of the club along the z-axis; and wherein the golf training device is formed of a biodegradable material.

17. The golf training device of claim 16, wherein the golf training device is affixed to a front striking surface of the face of the golf club.

18. The golf training device of claim 16 further comprising:

a backing surface that affixes the golf training device to the club.

19. The golf training device of claim 16, wherein the bottom protrusion deflects the ball when the face of the club is not at a correct distance from the ground at impact.

* * * * *